United States Patent [19]

Brown et al.

[11] 4,135,861

[45] Jan. 23, 1979

[54] JET PUMP WITH CERAMIC VENTURI

[75] Inventors: Francis B. Brown, La Crescenta; John W. Erickson, Huntington Beach; Harold L. Petrie, Pasadena, all of Calif.

[73] Assignee: Kobe, Inc., Huntington Park, Calif.

[21] Appl. No.: 794,963

[22] Filed: May 9, 1977

[51] Int. Cl.[2] ..... F04F 5/44

[52] U.S. Cl. ..... 417/183; 417/195; 417/DIG. 1; 417/172

[58] Field of Search ..... 417/195, 151, 172, DIG. 1, 417/183, 198

[56] References Cited

U.S. PATENT DOCUMENTS

| | | | |
|---|---|---|---|
| 2,463,317 | 3/1949 | Sanders | 417/172 |
| 2,489,636 | 11/1949 | Gurley | 417/195 X |
| 2,909,127 | 10/1959 | Bradaske | 417/172 |
| 3,601,513 | 8/1971 | White | 418/179 X |

*Primary Examiner*—Carlton R. Croyle
*Assistant Examiner*—Richard E. Gluck
*Attorney, Agent, or Firm*—Christie, Parker & Hale

[57] ABSTRACT

A jet pump has a nozzle for a power fluid, a Venturi for the power fluid and a well fluid, and a passage for the well fluid radially outside the Venturi and into the discharge of the nozzle. The power fluid aspirates the well fluid and the combined stream enters the Venturi. The Venturi is ceramic for erosion control. A shell sheaths the ceramic throughout its length and loads the ceramic compressively to provide a compressive preload on it. This preload opposes radial, outward acting stress in the Venturi arising from a greater fluid pressure within the Venturi than the fluid pressure outside it. The preload also produces a friction lock to keep the Venturi from sliding out of the shell because of an axial pressure differential.

9 Claims, 2 Drawing Figures

JET PUMP WITH CERAMIC VENTURI

BACKGROUND OF THE INVENTION

The present invention relates in general to jet pumps and, in particular, to jet pumps having ceramic nozzles.

Jet pumps are well known. Typically a power fluid under relatively high pressure passes through a nozzle and aspirates into its stream a fluid to be pumped, say, well fluid. The combined stream, often referred to as production fluid, enters the throat of a Venturi and passes into a diffuser of the Venturi where the streams slow down to recover static pressure head.

One purpose for a jet pump is to remove well fluid that has considerable solid content from a petroleum well. An example of the solids is sand.

Solids in a well fluid may be erosive. The Venturi of a jet pump has a comparatively small passage, the throat, that the power and well fluid streams pass through at high velocity. The erosive power of solids at these high velocities may be considerable. This has led to the throats of jet pump Venturis being eroded away. The solution to these problems has been to make Venturis out of ceramic materials because these materials resist erosion.

One way that a ceramic Venturi has been held in place has been by cementing it at its ends to support structure.

The Venturi of jet pumps can be subjected to considerable pressure differentials across their walls. For example, the static pressure of power fluid augmented by gravity at a downhole location can result in pressures of about 6,000 p.s.i. The pressure of well fluid of the formation may be about 1,000 p.s.i. Well fluid at 1,000 p.s.i. acting radially inward on a ceramic venturi opposes pressure within the Venturi and acting radially outward of about 6,000 p.s.i. with the net result that the Venturi is loaded in tensile hoop stress to a considerable degree.

Basic calculations indicate under the conditions just outlined that the ceramics used should be able to withstand this tensile hoop stress, but in fact failures have occurred. It is hypothesized that these failures in the ceramic are due to flaws in the material.

It is also known that ceramic materials are much stronger in compression than they are in tension.

SUMMARY OF THE INVENTION

The present invention provides a jet pump with a ceramic Venturi received in a compression sleeve that loads the Venturi compressively against expected pressure differentials across it which tend to load the Venturi in tension. This arrangement takes advantage of the high strength of ceramic materials in compression to offset and reduce tension stress.

One form of the present invention contemplates a jet pump having an axial nozzle, passage means for a power fluid to the nozzle, oriented say, axially, and a Venturi assembly axially of the nozzle. Passages for a fluid to be pumped, say, well fluid, lead in from fluid passages extending longitudinally along the outside of the Venturi assembly to the discharge of the nozzle for aspiration of the fluid to be pumped into the power fluid stream. A compression shell receives and compressively preloads the ceramic Venturi along the latter's entire length. The Venturi assembly discharges to an outlet of the pump. The pressure of the fluid to be pumped acts on the Venturi assembly and tends to create compressive hoop stresses therein. The fluid pressure within the Venturi assembly tends to create tensile hoop stress in the Venturi assembly.

In a particular form, the present invention contemplates a nozzle assembly axially of the assembly of the ceramic Venturi and shell. The nozzle assembly includes a nozzle retainer and a sleeve. The sleeve mounts on the shell of the Venturi assembly over an end of the shell and receives the nozzle retainer. The nozzle itself is received and held by the nozzle retainer and defines an axial passage. The passage has a minor diameter at its exit. The exit aims at the entrance to the Venturi and at the Venturi's throat. The nozzle retainer has axial passages for well fluid to pass longitudinally of the nozzle, after a reentry turn upon itself, to radial ports that exit at the nozzle exit. The power fluid flowing through the nozzle aspirates well fluid, and a combined stream of power and well fluid forms. An outer sleeve receives the nozzle assembly sleeve and the Venturi assembly concentrically. The Venturi assembly at its diffuser end secures to a plug that in turn secures to the outer sleeve. Longitudinal passages through the plug provide for passage of well fluid. The diffuser of the Venturi empties into a product fluid passage of the plug and radial ports from this passage lead to the outside pump, typically into an annular space externally of the pump proper and in the production fluid line of the well. A plug defines a radial bounding wall of the well fluid passages where they turn upon themselves and also anchors an end of the outer sleeve. This plug defines a bore that receives, serially, a connector tube, a retaining screw, and a locking screw, all having an axial passage for the power fluid. The connector tube receives in a bore of the nozzle assembly and butts up against a shoulder of that assembly.

These and other features, aspects, and advantages of the present invention will become more apparent from the following description, appended claims, and drawings.

DESCRIPTION OF THE PREFERRED EMBODIMENTS

Figures 1, 2:
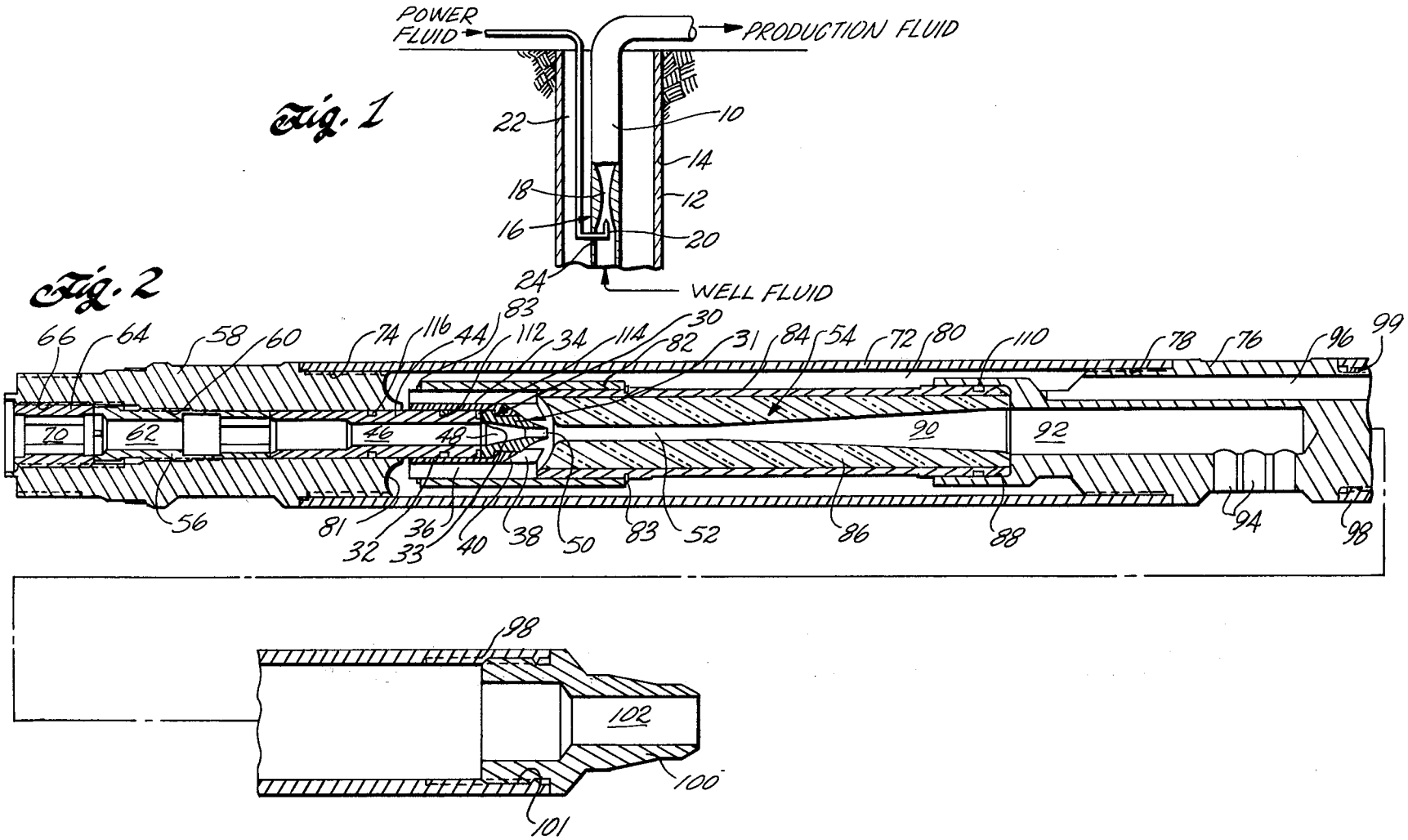
FIG. 1 schematically illustrates a jet pump in place in a petroleum well.
FIG. 2 illustrates the preferred form of the jet pump of the present invention in longitudinal half section.

FIG. 1 illustrates how a jet pump works in a petroleum well. A line of pipe 10 in a casing 12 of a well 14 contains a jet pump 16. The pump has a Venturi 18 and a nozzle 20. A line 22 from a source of power fluid supplies the nozzle. Nozzle 20 lies on the axis of Venturi 18. Power fluid passing through line 22 and out nozzle 20 produces a region around it of reduced pressure. This region is used to draw well fluid into the region. The power fluid and well fluid pass into a Venturi throat and then into a diffuser section of the Venturi. A passage 24 in line 10 for this well fluid communicates with the Venturi and nozzle. Aspirated well fluid and power fluid pass together through the Venturi as production fluid up line 10 to the surface. The environment of the well can include abrasive materials, such as sand. Abrasive material entrained in well fluid erodes those materials over which it passes at a high speed. One such zone of high speed passage is the Venturi, particularly the Venturi throat. It has been the practice to provide Venturies of ceramic material to resist erosion. These materials, though strong in compression, are weak in tension and when a large pressure differential exists across them loading them in tension, there can be failures.

The present invention overcomes the weakness of ceramic material in tension by preloading the material in compression so that compressive stress opposes and offsets tensile stress. Preloading is preferably by a sleeve that encases the ceramic Venturi and compressively loads it throughout its length. The load also secures the sleeve and Venturi together against unbalanced axial forces.

FIG. 2 illustrates the construction of the preferred jet pump of the present invention. A nozzle assembly 30 lies concentrically on the longitudinal axis of the pump within a body of the pump. It includes a nozzle proper 31 secured axially in a bore of a nozzle adapter 32 by abutting external and internal flanges 33 of the nozzle and adapter retainer 34. A nozzle retainer 34 receives the adapter and has a plurality of longitudinal passages 36 opening into generally radial passages 38. Lands 40, seen at the nose end of the nozzle, space adjacent of the passages 36 and radially support the nozzle assembly. A connector tube 44 lying on the axis of the pump receives in adapter 32 of the nozzle assembly and extends axially away from that assembly towards a posterior end of the pump. This end corresponds in a well to the upper end of the pump. Connector tube 44 has an axial passage 46 that empties into a passage 48 of the nozzle. Passage 48 narrows to nozzle throat 50. Nozzle throat 50 discharges into a throat 52 of a Venturi assembly 54. A retaining screw 56 threads into threads of a posterior plug 58 at 60 and butts up against the posterior end of connector tube 44. A passage 62 in the retaining screw communicates with passage 46 of the connector tube. A locking screw 64 threads into threads of plug 58 at 66 and butts up against retaining screw 56. A passage 70 through the locking screw opens into passage 62 of the retaining screw. The retaining screw can be positioned to vary the position of connector tube 44 and hence the nozzle assembly with respect to the throat of the Venturi body.

A sleeve 72 is attached to plug 58 as at thread 74 at a posterior end of the sleeve. At an anterior end of the sleeve the sleeve attaches to a second plug 76 by threads 78. A longitudinal annular passage 80 between sleeve 72 and Venturi assembly 54 passes well fluid up the pump and into longitudinal passages 36 of the nozzle assembly for aspiration into the power fluid stream and introduction into throat 52 of the Venturi assembly. Curved surface 81 aids in directing the turning of fluid between passage 80 and passages 36. A sleeve 82 concentric with the axis of the pump attaches to the Venturi assembly and receives nozzle retainer 34 to hold it to the Venturi assembly. Sleeve 82 forms the outer radial wall of passages 36. Retainer rings 83 secure sleeve 82 to a shell 84 of Venturi assembly 54 and nozzle retainer 34.

A compression shell 84 of Venturi assembly 54 receives in the sleeve and encases a ceramic Venturi body 86. The shell compressively loads the ceramic material and this results in substantially strengthening the Venturi assembly. Shell 84 is received in a bore 88 of plug 76. Venturi 86 has a diffuser in the form of a diverging passage 90 beginning at throat 52 and ending at a junction between it and a passage 92 of plug 76. Passage 92 opens into radial ports 94 that exit production fluid, power fluid, and well fluid into an annulus between the pump and production line for passage up to the surface of the well.

Well fluid passes through plug 76 in a passage 96 of the plug. Plug 76 attaches to an anterior tube 98 as by threads 99, and tube 98 attaches to an anterior or bottom plug 100 as by threads 101. Plug 100 has a passage 102 for receiving well fluid. Well fluid, then, goes into passage 102, into the interior of anterior tube 98, into passage 96 of plug 76, into passage 80 between sleeve 72 and Venturi assembly 54, turns on itself and passes up longitudinal passages 36, entrains in a nozzle stream emanating from nozzle throat 50, and passes into throat 52 of the Venturi assembly.

The pressure of the well fluid outside shell 84 acting on ceramic Venturi body 86, though high, is considerably less in the normal case than the pressure acting outwardly on the ceramic Venturi body by the fluid flowing through throat 52 and diverging passage 90. A typical pressure differential may be 5,000 p.s.i. Ceramic materials are strong in compression but weak in tension. While theoretical calculations show that in a nornal environment an unsupported ceramic Venturi should be able to withstand the tensile hoop stress in it produced by the pressure differential between the fluid flowing through it and fluid flowing around it, the imperfections in the ceramic material have resulted in failures. By compressively loading the ceramic portion of the Venturi assembly by a steel tube or shell throughout the length of the ceramic body, the failure problem has been overcome. A considerable compressive preload can exist on the ceramic material of the Venturi body. These materials have compressive strengths in the neighborhood of 300,000 p.s.i. The compressive load should be sufficient to ensure the retaining of the ceramic body with the shell against axial differential pressures acting on the ceramic body. Such a differential exists because the pressure acting on the posterior end of the body in the region of radial passages 38 will be less than the pressure acting in the diffuser section of the Venturi.

To keep fluids where they belong, various of the parts are sealed. An "O" ring in a channel 110 of shell 84 seals the interface between the shell and plug 76. "O" rings in channels 112 and 114 of connector tube 44 provide a seal between the interface of connector tube 44 and adapter 32. A similar "O" ring 116 channel for an "O" ring between the connector tube and plug 58 seals the interface there.

The present invention has been described with reference to a certain preferred embodiment. The spirit and scope of the appended claims should not, however, necessarily be limited to the foregoing description.

What is claimed is:

1. An improved jet pump comprising:

(a) a nozzle for increasing the velocity head of a high total head power fluid stream and discharging such fluid with the increased velocity head;

(b) means for mounting the nozzle in the jet pump;

(c) passage means to the nozzle to supply the power fluid thereto;

(d) a Venturi assembly, having a longitudinal axis, the Venturi assembly including a Venturi body of ceramic material having a throat aligned with the nozzle to receive the discharge therefrom, and a diffuser opening into the throat and having a progressively greater diameter as the axial distance from the throat increases, the outside of the Venturi assembly being cylindrical and of substantially constant diameter, whereby the wall thickness of the Venturi assembly decreases in the diffuser as the axial distance from the throat increases;

(e) a shell of the Venturi assembly compressively loading the ceramic Venturi body and substantially completely encasing the body throughout its length;

(f) means for mounting the Venturi assembly in the jet pump;

(g) passage means for supplying a fluid to be pumped to the discharge of the nozzle upstream from the Venturi throat, such fluid to be pumped passage means including a portion radially outside the Venturi assembly such that pressure of the fluid in such fluid to be pumped passage means acts radially inward on the Venturi assembly; and (h) the Venturi assembly being disposed such that fluid pressure acting radially outward and creating tensile hoop stress is greater than any fluid pressure acting radially inward and creating compressive hoop stress.

2. The improved jet pump claimed in claim 1 wherein the jet pump includes an outer sleeve, the Venturi assembly being within the sleeve and the passage means for the fluid to be pumped including a section between the sleeve and the Venturi assembly.

3. An improved jet pump comprising:

a body having longitudinal passage means therein for a fluid to be pumped;

a Venturi assembly within the body and radially interiorly of the passage means for the fluid to be pumped, the Venturi assembly including a Venturi body defining a throat and a diffuser, and a shell encasing the Venturi body, loading the Venturi body in radial compression, and forming an interior wall of the passage means for the fluid to be pumped, the shell extending for substantially completely the entire length of the Venturi body, the Venturi body being formed of a material which is strong in compression, weak in tension, and resistant to erosion, the Venturi body having a progressively thinner wall thickness in the diffuser as axial distance from the throat increases;

a nozzle assembly within the body and comprising a nozzle and passage means for a power fluid to the nozzle, the nozzle being oriented axially of the throat of the Venturi body and spaced therefrom, radial passage means of the nozzle assembly communicating the passage means for fluid to be pumped to the discharge of the nozzle in the space between the nozzle and the throat of the Venturi body;

a sleeve within the body connected to the shell of the Venturi assembly and to the nozzle assembly, the sleeve receiving the nozzle assembly and supporting the end of the Venturi assembly at the throat end thereof; and passage means from the Venturi assembly to outside the pump for the product fluid of the pump.

4. The improved jet pump claimed in claim 3 wherein the sleeve connecting the shell of the Venturi assembly and the nozzle assembly and the nozzle assembly define a short longitudinal passage forming a part of the overall passage means for the fluid to be pumped, the longitudinal passage means thus defined paralleling a portion of the rest of the passage means for fluid to be pumped, directing fluid to be pumped in the direction opposite from the paralleled portion of the rest of the passage means and opening into the radial passage means.

5. The improved jet pump claimed in claim 4 wherein the nozzle assembly includes a nozzle retainer receiving the nozzle and being received in the sleeve connecting the shell of the Venturi assembly and the nozzle assembly, the nozzle retainer and the sleeve connecting the shell of the Venturi assembly and the nozzle assembly defining the short longitudinal passage for the fluid to be pumped.

6. The improved jet pump claimed in claim 5 wherein the body includes an elongate sleeve, a first plug attached to one end of the sleeve, and a second plug attached to the other end of the sleeve, the elongate sleeve receiving the nozzle assembly, the Venturi assembly and the first mentioned sleeve.

7. The improved jet pump claimed in claim 6 wherein a connecting tube is provided, the connecting tube defining a passage for the power fluid, the nozzle assembly being mounted on the connecting tube, the nozzle passage for power fluid being in communication with passage of the connecting tube, the first plug supporting the connecting tube.

8. The improved jet pump claimed in claim 7 wherein the second plug supports the Venturi assembly on the end thereof opposite the sleeve connecting the shell of the Venturi assembly and the nozzle assembly, the second plug having the passage means from the Venturi assembly to outside the pump.

9. The improved jet pump claimed in claim 8 wherein a retaining screw and a locking screw are included, the screws being mounted in the first plug with the retaining screw abutting against the connecting tube and the locking screw abutting against the retaining screw, the screws having passages in communication with each other and the passage of the connecting tube for power fluid.

* * * * *